US009863070B2

(12) United States Patent
Zhang et al.

(10) Patent No.: US 9,863,070 B2
(45) Date of Patent: Jan. 9, 2018

(54) TUBULAR PROTECTIVE SLEEVE WITH CURL RESISTANT KNIT ENDS AND METHOD OF CONSTRUCTION THEREOF

(71) Applicant: Federal-Mogul Powertrain, Inc., Southfield, MI (US)

(72) Inventors: Zhong Huai Zhang, Pottstown, PA (US); Linwood Ludy, Pottstown, PA (US)

(73) Assignee: Federal-Mogul Powertrain LLC, Southfield, MI (US)

( * ) Notice: Subject to any disclaimer, the term of this patent is extended or adjusted under 35 U.S.C. 154(b) by 510 days.

(21) Appl. No.: 14/563,786

(22) Filed: Dec. 8, 2014

(65) Prior Publication Data

US 2016/0160410 A1 Jun. 9, 2016

(51) Int. Cl.

| | |
|---|---|
| ***D04B 1/22*** | (2006.01) |
| ***D04B 7/30*** | (2006.01) |
| ***D04B 1/10*** | (2006.01) |

(52) U.S. Cl.

CPC ..... *D04B 1/225* (2013.01); *D04B 1/106* (2013.01); *D04B 7/30* (2013.01); *D10B 2505/12* (2013.01)

(58) Field of Classification Search

CPC ..... D04B 1/106; D04B 1/108; D04B 1/225; D04B 1/26; D04B 1/265

See application file for complete search history.

(56) References Cited

U.S. PATENT DOCUMENTS

| | | | | |
|---|---|---|---|---|
| 4,180,065 | A * | 12/1979 | Bowen | A61F 13/08 2/239 |
| 4,341,096 | A * | 7/1982 | Safrit | A41B 11/005 2/239 |
| 4,571,960 | A * | 2/1986 | Hursh | A41B 11/005 2/239 |
| 5,271,249 | A | 12/1993 | Mitsumoto et al. | |
| 5,509,282 | A * | 4/1996 | Ferrell, Jr. | A41B 11/005 2/239 |
| 5,584,197 | A | 12/1996 | Okuno | |
| 5,669,244 | A | 9/1997 | Okuno | |
| 5,675,992 | A * | 10/1997 | Wrightenberry | A41B 11/005 2/239 |

(Continued)

FOREIGN PATENT DOCUMENTS

| | | |
|---|---|---|
| DE | 19653315 A1 | 6/1998 |
| EP | 1956125 A1 | 8/2008 |

(Continued)

OTHER PUBLICATIONS

International Search Report, dated Apr. 6, 2016 (PCT/US2015/064386).

*Primary Examiner* — Danny Worrell
(74) *Attorney, Agent, or Firm* — Robert L. Stearns; Dickinson Wright, PLLC

(57) ABSTRACT

A knit sleeve for providing protection to elongate members and method of construction thereof is provided. The sleeve includes a tubular knit wall having opposite end regions extending to opposite free ends and an intermediate region extending between said end regions. The intermediate region is formed as a circumferentially continuous, single knit layer and the end regions are formed having knit inner and outer layers, wherein the knit inner and outer layers inhibit the end regions from curling outwardly.

16 Claims, 2 Drawing Sheets

(56) References Cited

U.S. PATENT DOCUMENTS 5,826,445 A 10/1998 Okamoto
6,047,569 A 4/2000 Shima
6,571,584 B1 6/2003 Okayama
6,655,175 B1 12/2003 Okamoto
6,658,898 B2 12/2003 Okamoto
6,658,900 B2 12/2003 Okamoto
6,668,593 B2 12/2003 Okamoto
6,672,113 B2 1/2004 Okamoto
6,711,920 B2 * 3/2004 Akers ..... F16L 57/04 138/123
6,786,066 B2 9/2004 Okamoto
6,789,402 B2 9/2004 Okamoto
6,840,064 B2 1/2005 Okamoto
6,889,530 B2 5/2005 Urano et al.
6,978,643 B2 * 12/2005 Akers ..... F16L 59/029 66/170
6,983,626 B2 1/2006 Okamoto
7,181,932 B2 2/2007 Kosui
7,395,680 B2 * 7/2008 Baer ..... D04B 21/16 66/170
7,460,926 B2 12/2008 Okamoto
7,469,563 B2 * 12/2008 Wahlgren ..... F01N 1/24 66/169 R
7,529,596 B2 5/2009 Okamoto
7,577,488 B2 8/2009 Okamoto
7,647,946 B2 * 1/2010 Mirmand ..... D04B 1/04 138/110
7,693,599 B2 4/2010 Okamoto
7,757,517 B2 * 7/2010 Malloy ..... D04B 1/225 66/170
7,823,420 B2 * 11/2010 Andrieu ..... F16L 57/06 66/170
7,874,184 B2 * 1/2011 Malloy ..... D04B 1/22 66/170
8,505,339 B2 * 8/2013 Malloy ..... F01N 13/148 66/170
8,557,358 B1 * 10/2013 Hennings ..... B29D 22/00 428/34.4
9,293,898 B2 * 3/2016 Relats Casas ..... F16L 57/06
2014/0260436 A1 * 9/2014 Putta ..... D04B 1/225 66/170
2014/0273699 A1 * 9/2014 Zhang ..... D04B 21/14 442/316

FOREIGN PATENT DOCUMENTS

FR 2647816 A 12/1990
GB 2141147 A 12/1984
WO 2004001780 A2 12/2003
WO 2012044916 A1 4/2012

* cited by examiner

FIG. 1
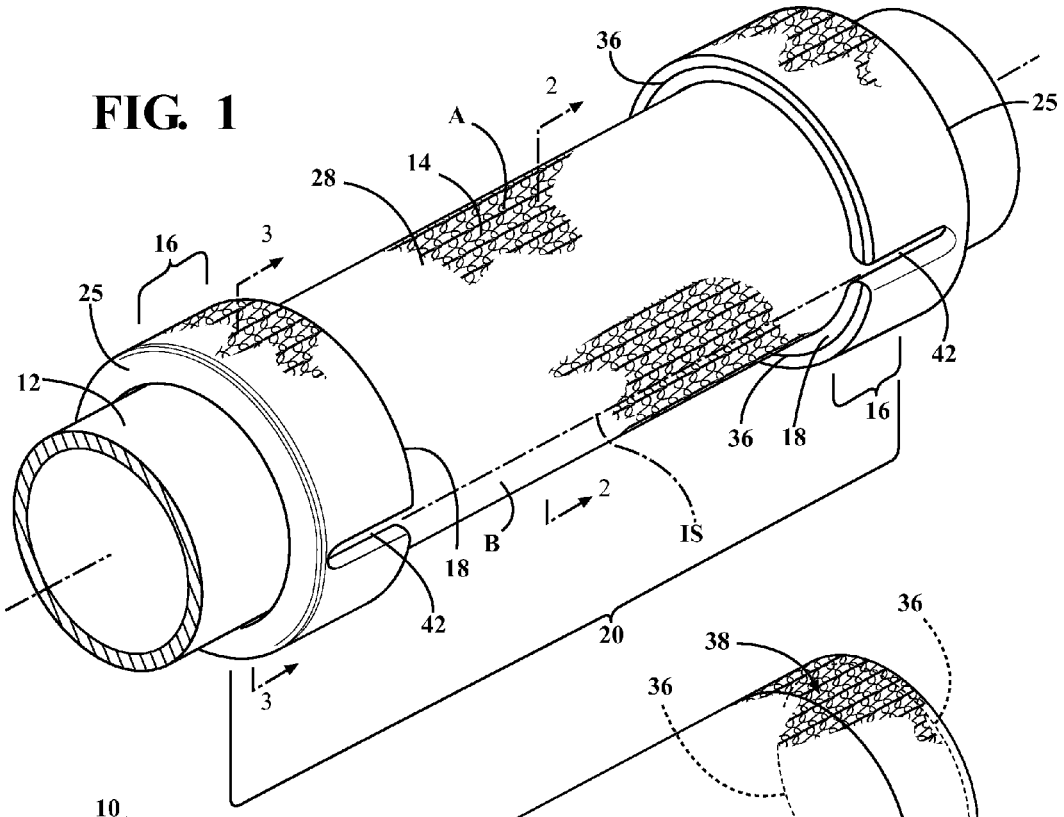
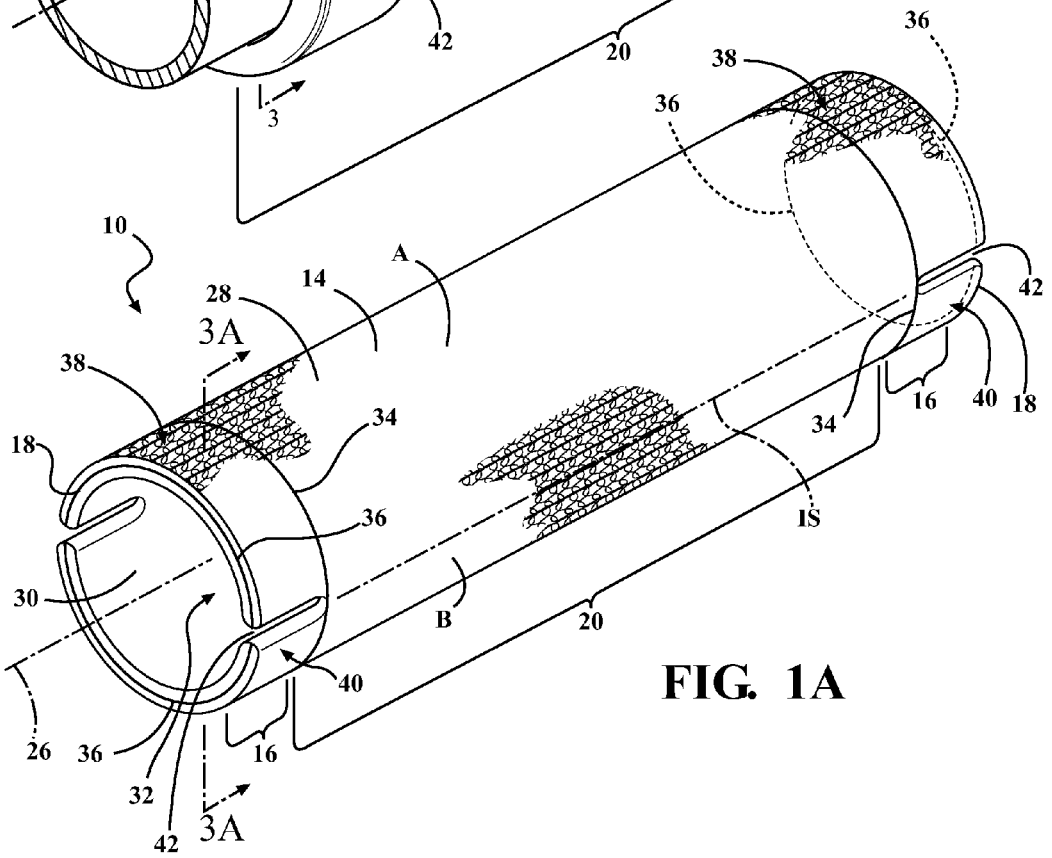
FIG. 1A

TUBULAR PROTECTIVE SLEEVE WITH CURL RESISTANT KNIT ENDS AND METHOD OF CONSTRUCTION THEREOF

BACKGROUND OF THE INVENTION

1. Technical Field

This invention relates generally to tubular protective sleeves for providing protection to elongate members contained therein, and more particularly to knit tubular protective sleeves and to their method of construction.

2. Related Art

Tubular sleeves are known for protecting elongate members, such as wires and pipes, against abrasion and thermal conditions. The sleeves are commonly constructed from heat resistant yarns, such as silica, fiberglass, ceramic, basalt, aramid or carbon, to withstand relatively high temperatures, wherein the heat-resistant yarns are generally not heat-formable. Sleeves constructed from such heat-resistant yarns are commonly used to insulate high temperature tubes, such as those providing a conduit for hot liquid, to inhibit the heat from radiating outwardly beyond the confines of the tubing. Also, the sleeves are used to protect the contents within the sleeves, such as a wire harness, for example, from exposure to heat external to the sleeve. Although the sleeves are generally effective in providing a thermal barrier to heat flow therethrough, the ends of the knit sleeves tend to curl outwardly upon being knit due to the tension applied between interconnected loops of yarn, thereby forming bulky, radially outwardly flared or rolled back ends. The curled ends not only appear unsightly, but they reduce the effective overall length of the sleeve, as well as add bulk to the outer envelope of the sleeve which can impact the ability to install the covered pipe or wire assembly in tight spaces.

SUMMARY OF THE INVENTION

In accordance with one aspect of the invention, a knit sleeve for providing protection to elongate members is provided. The sleeve includes a tubular knit wall having opposite end regions extending to opposite free ends and an intermediate region extending between the end regions. The intermediate region is formed as a single knit layer and the end regions are formed having knit inner and outer layers, wherein the knit inner and outer layers cooperate with one another to prevent the end regions from curling outwardly.

In accordance with another aspect of the invention, each end region can be knit having a pair of dual layer sections diametrically opposite one another, wherein the pair of dual layer sections can be circumferentially spaced from one another by a pair of diametrically opposed gaps.

In accordance with another aspect of the invention, the inner and outer layers of each dual layer section are knit to enclose a cavity.

In accordance with another aspect of the invention, the inner and outer layers of each dual layer section are knit to merge with one another at the single intermediate layer.

In accordance with another aspect of the invention, the inner and outer layers of each dual layer section are knit to merge with one another at the free ends.

In accordance with another aspect of the invention, the wall can be knit entirely with non-heat-settable yarn.

In accordance with another aspect of the invention, a method of constructing a tubular textile sleeve for containing an elongate member therein is provided. The method includes knitting a tubular wall having knit opposite end regions extending to opposite free ends with a knit intermediate region extending between the knit end regions. While knitting the tubular wall, the method further includes knitting the intermediate region as a single layer and knitting the end regions having inner and outer layers, such that the end regions are inhibited from curling radially outwardly by the counteracting forces imparted by the inner and outer layers.

In accordance with another aspect of the invention, the method can further include knitting each end region having a pair of dual layer sections, with each of the dual layer sections within each pair of dual layer sections being diametrically opposite one another and with the diametrically opposite dual layer sections within each pair of dual layer sections being spaced circumferentially from one another by a pair of gaps.

In accordance with another aspect of the invention, the method can further include knitting the wall on a flatbed knitting machine having a pair of opposing beds and knitting each dual layer section with needles from both beds.

In accordance with another aspect of the invention, the method further includes knitting the inner and outer layers of the end regions to merge with one another at the single intermediate layer.

In accordance with another aspect of the invention, the method further includes knitting the inner and outer layers of the end regions to merge with one another at the free ends.

In accordance with another aspect of the invention, the method can further include knitting the wall entirely with non-heat-settable yarn.

In accordance with another aspect of the invention, a method of installing a tubular sleeve about an elongate member is provided. The method includes providing a tubular knit wall having opposite end regions with an intermediate region extending between the end regions. The intermediate region is formed as a knit single layer and the end regions are formed having knit inner and outer layers. The method further includes reverse folding the end regions over an adjacent portion of the intermediate region, and further, sliding the tubular knit wall about the elongate member.

In accordance with another aspect of the invention, the method of installing the tubular sleeve can further include forming each end region having a pair of dual layer sections diametrically opposite one another with the pair of dual layer sections being circumferentially spaced from one another by a pair of diametrically opposed gaps, wherein the gaps facilitate reverse folding of the dual layer sections.

In accordance with another aspect of the invention, the method of installing the tubular sleeve can further include providing the tubular knit wall being free of heat-settable yarn.

BRIEF DESCRIPTION OF THE DRAWINGS

These and other aspects, features and advantages of the present invention will become more readily appreciated when considered in connection with the following detailed description of presently preferred embodiments and best mode, appended claims and accompanying drawings, in which:

FIG. 1 is perspective view of a knit tubular sleeve constructed in accordance with one aspect of the invention shown with an elongate tubular member to be protected extending therethrough;

FIG. 1A is a perspective view of the knit tubular sleeve of FIG. 1 shown in an uninstalled, pre-folded stated;

DETAILED DESCRIPTION OF PRESENTLY PREFERRED EMBODIMENTS

Figure 2:
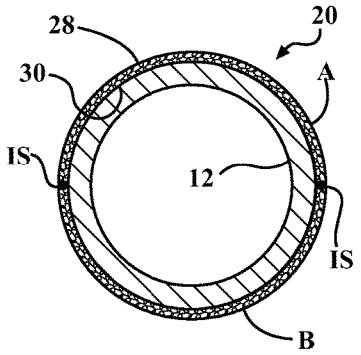
FIG. 2 is a cross-sectional view taken generally along the line 2-2 of FIG. 1.
Figure 3:
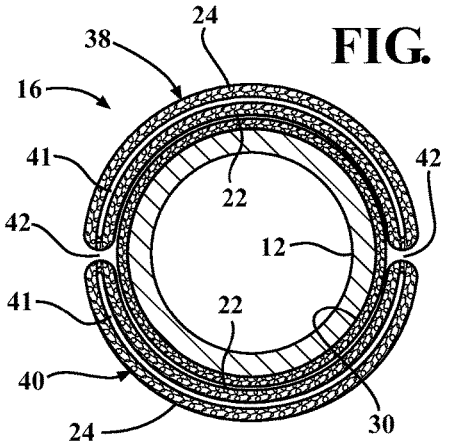
FIG. 3 is a cross-sectional view taken generally along the line 3-3 of FIG. 1.
Figure 3A:
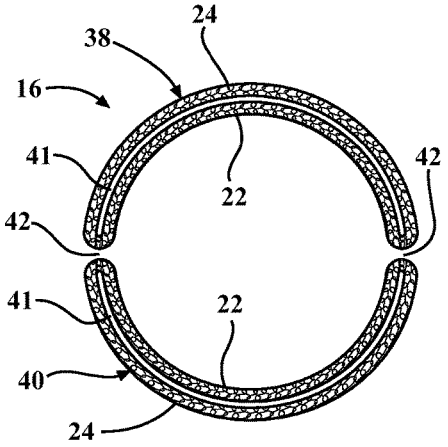
FIG. 3A is a cross-sectional view taken generally along the line 3A-3A of FIG. 1A.
Figure 4:
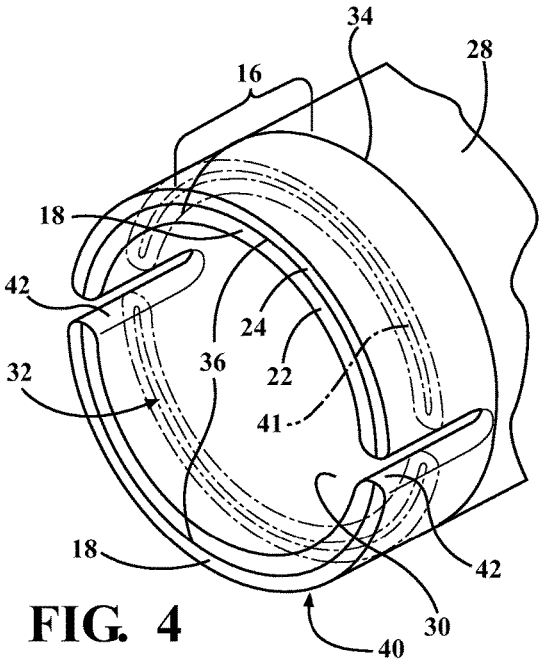
FIG. 4 is an enlarged partial view showing an end of the sleeve of FIG. 1A.

Referring in more detail to the drawings, FIG. 1 illustrates a knit protective tubular sleeve 10 constructed in accordance with one embodiment of the invention. The sleeve 10 is protective in that it provides a barrier to heat, whether preventing heat from radiating outwardly, such as from an elongate member 12 contained within the sleeve, e.g. hot pipes within an engine compartment or an exhaust pipe, or providing a barrier to an elongate member 12, e.g. wire harness or cable contained within the sleeve 10, against heat from radiating inwardly from nearby hot components, e.g. an exhaust pipe. The sleeve 10 also provides protection from environmental contaminants from entering and/or damaging the sleeve 10, such as hard, abrasive debris and liquid contaminants, e.g. fuel, oil, water. The sleeve 10 has a tubular knit wall 14 with opposite end regions 16 extending to opposite free ends 18 and an intermediate region 20 extending between the end regions 16. The intermediate region 20 is formed as a single knit layer and the end regions 16 are formed having a knit inner layer 22 and a knit outer layer 24, wherein the knit inner and outer layers 22, 24 cooperate with one another via counteracting forces imparted on one another to prevent the end regions 16 from curling radially outwardly. In an assembled state, as shown in FIG. 1, the dual layer end regions 16 are folded back over an adjacent portion of the intermediate region 20, such that the end regions 16 form reverse folded, cuffed regions. The cuffed end regions 16 act to apply a radially compressive force about the underlying section of the intermediate region 20, thereby inhibiting the newly formed ends 25 from curling radially outwardly. As such, by inhibiting the ends 25 from curling radially outwardly, aside from preventing the sleeve from appearing unsightly, the intended maximum outer diameter of the sleeve 10 is substantially maintained, and thus, installation of the sleeve 10 within tight spaces is enhanced, and the overall effective length of the sleeve 10 extending between the ends 25 is maximized, thereby providing optimal protective coverage to the elongate member 12 contained therein.

The textile sleeve 10 is knit via a computerized flatbed knitting machine, having opposing flat beds, with yarn to form the closed, circumferentially continuous wall 14 extending along a longitudinal axis 26 of the sleeve 10. With the sleeve wall 14 being constructed on a computerized flatbed knitting machine, the type of knit stitches can be varied, as desired, for the intended application. Accordingly, the wall 14 can be knit using any type or combination of knit stitches, e.g. jersey, interlock, rib forming stitches, or otherwise, such that the wall 14 may be knit using a single or multiple knit stitch types. Further, the wall 14 can be constructed having any suitable length and diameter. Further yet, the wall 14 can be constructed from varying types of yarn, such as in one presently preferred construction, by way of example, from a heat resistant, non-heat-settable yarn (multifilament and/or monofilament) suitable for withstanding extreme temperature environments ranging from between about −60 to 1400 degrees centigrade. Some of the selected multifilament yarns can be formed with mineral fiber materials, such as silica, fiberglass, ceramic, basalt, aramid or carbon, by way of example and without limitation. The mineral fibers can be provided having a continuous or chopped fiber structure. In some applications of extreme heat, it may be desirable to heat treat the sleeve material to remove organic content therefrom, thereby increasing the heat resistance capacity of the sleeve 10.

The knitted sleeve 10, in one presently preferred construction, can be constructed, at least in part, from a non-heat-settable, heat resistant material suitable for withstanding high temperature environments ranging from between about −60 to 1400 degrees centigrade. Some of the selected yarns could be formed with silica, fiberglass, ceramic, basalt, aramid or carbon, by way of example and without limitations. If desired, the sleeve 10 could also be coated to further enhance its heat resistance, and possibly to improve its abrasion resistance. It should be recognized that the sleeve could be constructed utilizing any type of material suitable for knitting a tubular sleeve, such as polyester, nylon, polypropylene, polyethylene, acrylic, cotton, rayon, and fire retardant (FR) versions of all the aforementioned materials, as desired for the intended application.

The wall 14 has an outer surface 28 and an inner surface 30 bounding a cavity 32 extending axially along the longitudinal axis 26 between the opposite free ends 18, prior to reverse folding, of the sleeve 10. The cavity 32 is formed having the desired diameter to contain the selected elongate member 12. The intermediate region 20 of the wall 14 is constructed as a single layer of knit yarns; however, the end regions 16 have the dual inner and outer layers 22, 24 extending axially from the intermediate section 20 to the respective free end 18. As such, the inner and outer layers 22, 24 are knit to merge with one another and with the intermediate region 20 along a seam 34 and are further knit to merge with one another along a knit bind off seam 36 at the respective free end 18. Of course, as discussed above, the end regions 16 are reverse folded about a neighboring portion of the intermediate region 20, thereby forming the finished, as assembled, end regions having three layers, including two layers from the dual layer end regions 16 and one layer from the underlying intermediate region 20.

In manufacture, one of the flat beds knits one full length, half portion A of the intermediate region 20 and the other of the flat beds simultaneously knits the opposite full length, half portion B of the intermediate region 20, wherein the opposite full length halves are simultaneously knit together along diametrically opposite knit intermediate seams IS. Then, upon knitting the intermediate region 20, a first one of the tubular end regions 16 is knit and then the second tubular end region 16 is knit, such that the tubular, dual walled end regions 16 merge with the single walled intermediate region 20.

Each end region 16 has a pair of dual layer, substantially tubular sections 38, 40 diametrically opposite one another, wherein the dual layer sections 38, 40 each have an enclosed cavity 41 formed via the inner and outer layers 22, 24. The individual dual layer sections 38, 40 are circumferentially spaced from one another by a pair of diametrically opposed gaps 42 formed during the knitting process. During knitting, to first form one of the end regions 16, one of the tubular dual layer sections 38 is first formed, such as via forming front stitches on a front bed and forming back stitches on empty needles from the opposite back bed, and then, upon forming the opposite layers 22, 24, the back stitch is transferred to the front bed, whereupon the bind off stitch seam 36 is formed to close of the cavity 41 at the free end 18. Then, an opposite one of the tubular dual layer sections 40 is formed, such as via forming back stitches on a back bed and forming front stitches on empty needles from the opposite front bed, and then, upon forming the opposite layers 22, 24, the front stitch is transferred to the back bed, whereupon the bind off stitch seam 36 is formed to close of the cavity 41 at the free end 18. The same process is then performed at the opposite end of the intermediate region 20 to form the opposite end region 16. As such, the inner and outer layers 22, 24 merge with one another at the single layer intermediate region 20 and with one another at the respective free end 18. Then, upon knitting the entirety of the wall 14, the tubular dual layer sections 38, 40 are reverse folded, as discussed above, to densify and enhance the radial structural integrity of the ends 25.

It is to be understood that the above detailed description is with regard to some presently preferred embodiments, and that other embodiments which accomplish the same function are incorporated herein within the scope of any ultimately allowed patent claims.

The invention claimed is:

1. A knit sleeve for providing protection to an elongate member, comprising:

a tubular knit wall bounding a cavity extending along a longitudinal axis and having opposite end regions extending to opposite free ends and an intermediate region extending between said end regions, said intermediate region being formed as a knit single layer and each of said end regions being formed having a pair of dual layer sections, each dual layer section including knit inner and outer layers, wherein said dual layer sections within each pair of dual layer sections are located on diametrically opposite sides of said longitudinal axis in radial alignment with one another and are circumferentially spaced from one another by a pair of diametrically opposed gaps.

2. The knit sleeve of claim 1 wherein said inner and outer layers of each dual layer section enclose a cavity.

3. The knit sleeve of claim 1 wherein each end regions is reversed folded over a portion of said intermediate region.

4. The knit sleeve of claim 1 wherein said inner and outer layers merge with one another at said knit single layer.

5. The knit sleeve of claim 4 wherein said inner and outer layers merge with one another at said free ends.

6. The knit sleeve of claim 1 wherein said wall is knit entirely with non-heat-settable yarn.

7. A method of constructing a tubular sleeve for protecting an elongate member contained therein, comprising the steps of:

knitting a tubular wall extending along a longitudinal axis and having opposite end regions extending to opposite free ends and an intermediate region extending between said end regions;

knitting the intermediate region as a single layer; and knitting each of the end regions having a pair of dual layer sections, each dual layer section including inner and outer layers, wherein the dual layer sections within each pair of dual layer sections are located on diametrically opposite sides of the longitudinal axis in radial alignment with one another and are circumferentially spaced from one another by a pair of diametrically opposed gaps.

8. The method of claim 7 further including knitting the inner and outer layers to enclose a cavity within each dual layer section.

9. The method of claim 7 further including knitting the wall on a flatbed knitting machine having a pair of opposing beds and knitting each dual layer section with both beds.

10. The method of claim 9 further including knitting one of the dual layer sections with both beds and then knitting the diametrically opposite dual layer section with both beds.

11. The method of claim 7 further including knitting the inner and outer layers to merge with one another at the single layer.

12. The method of claim 11 further including knitting the inner and outer layers to merge with one another at the free ends.

13. The method of claim 7 further including knitting the wall entirely with non-heat-settable yarn.

14. The method of claim 7 further including knitting the entire wall on a flatbed knitting machine.

15. A method of installing a tubular sleeve about an elongate member, comprising:

providing a tubular knit wall having opposite end regions with an intermediate region extending between the end regions, the intermediate region being formed as a knit single layer and each of the end regions being formed having a pair of dual layer sections, each dual layer section including knit inner and outer layers, wherein the dual layer sections within each pair of dual layer sections are located on diametrically opposite sides of the longitudinal axis in radial alignment with one another and are circumferentially spaced from one another by a pair of diametrically opposed gaps;

reverse folding the pair of dual layer sections at each of the end regions over an adjacent portion of the intermediate region; and sliding the tubular knit wall about the elongate member.

16. The method of claim 15 further including providing the tubular knit wall being free of heat-settable yarn.

* * * * *